US008015806B2

(12) United States Patent
Treiber

(10) Patent No.: US 8,015,806 B2
(45) Date of Patent: Sep. 13, 2011

(54) PROCESS AND APPARATUS FOR TREATING EXHAUST GAS OF AN INTERNAL COMBUSTION ENGINE AND VEHICLE HAVING THE APPARATUS

(75) Inventor: Peter Treiber, Monheim (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 12/031,946

(22) Filed: Feb. 15, 2008

(65) Prior Publication Data

US 2008/0196400 A1 Aug. 21, 2008

Related U.S. Application Data

(63) Continuation of application No. PCT/EP2006/007975, filed on Aug. 11, 2006.

(30) Foreign Application Priority Data

Aug. 15, 2005 (DE) ..... 10 2005 038 707

(51) Int. Cl.
*F01N 3/00* (2006.01)

(52) U.S. Cl. ..... 60/297; 60/288; 60/311; 60/324

(58) Field of Classification Search ..... 60/274, 60/277, 287, 288, 297, 311, 324; 55/DIG. 30, 55/312
See application file for complete search history.

(56) References Cited

U.S. PATENT DOCUMENTS

| | | | | |
|---|---|---|---|---|
| 4,386,497 | A | 6/1983 | Takagi et al. | |
| 4,725,411 | A | 2/1988 | Cornelison | |
| 5,582,002 | A * | 12/1996 | Pattas | 60/274 |
| 5,655,366 | A * | 8/1997 | Kawamura | 60/286 |
| 5,956,944 | A * | 9/1999 | Dementhon et al. | 60/274 |
| 5,974,791 | A * | 11/1999 | Hirota et al. | 60/276 |
| 6,233,926 | B1 | 5/2001 | Bailey et al. | |
| 6,568,178 | B2 * | 5/2003 | Hirota et al. | 60/297 |
| 6,679,051 | B1 * | 1/2004 | van Nieuwstadt et al. | 60/286 |
| 6,708,486 | B2 * | 3/2004 | Hirota et al. | 60/297 |
| 6,712,884 | B2 | 3/2004 | Brück et al. | |
| 6,742,328 | B2 * | 6/2004 | Webb et al. | 60/285 |
| 6,745,560 | B2 * | 6/2004 | Stroia et al. | 60/286 |
| 6,820,414 | B2 * | 11/2004 | Stroia et al. | 60/286 |

(Continued)

FOREIGN PATENT DOCUMENTS

CH 663253 A5 11/1987

(Continued)

*Primary Examiner* — Tu M Nguyen
(74) *Attorney, Agent, or Firm* — Laurence A. Greenberg; Werner H. Stemer; Ralph E. Locher

(57) ABSTRACT

A process and an apparatus for treating exhaust gas from an internal combustion engine include at least two exhaust-gas treatment modules. An exhaust gas stream can be at least partly deflected depending on a load state of the internal combustion engine in such a way that at least parts of the exhaust gas flow through one or more modules. This makes it possible to advantageously construct and operate even an exhaust gas system of large-volume internal combustion engines, in which conversion and treatment of the exhaust gas is carried out in individual modules, even in no-load operation, basically at very low exhaust gas mass flow rates. The individual modules can be adapted to various load levels of the internal combustion engine. A rail-borne vehicle and a water-borne vehicle having the apparatus are also provided.

8 Claims, 4 Drawing Sheets

U.S. PATENT DOCUMENTS

| | | | | |
|---|---|---|---|---|
| 6,959,542 | B2 * | 11/2005 | Taylor et al. | 60/295 |
| 7,314,501 | B2 | 1/2008 | Fayard | |

FOREIGN PATENT DOCUMENTS

| | | | |
|---|---|---|---|
| DE | 69717743 | T2 | 5/2003 |
| EP | 0 829 622 | A1 | 3/1998 |
| FR | 2209400 | | 6/1974 |
| GB | 1 429 816 | | 3/1976 |
| JP | 10089049 | A | 4/1998 |
| JP | 2001289032 | A | 10/2001 |
| JP | 2005069238 | A | 3/2005 |
| WO | 0200326 | A2 | 1/2002 |
| WO | 03/102389 | A2 | 12/2003 |

* cited by examiner

PROCESS AND APPARATUS FOR TREATING EXHAUST GAS OF AN INTERNAL COMBUSTION ENGINE AND VEHICLE HAVING THE APPARATUS

CROSS-REFERENCE TO RELATED APPLICATIONS

This is a continuation, under 35 U.S.C. §120, of copending International Application No. PCT/EP2006/007975, filed Aug. 11, 2006, which designated the United States; this application also claims the priority, under 35 U.S.C. §119, of German Patent Application DE 10 2005 038 707.1, filed Aug. 15, 2005; the prior applications are herewith incorporated by reference in their entirety.

BACKGROUND OF THE INVENTION

Field of the Invention

The present invention relates to a process and an apparatus for treating an exhaust gas from an internal combustion engine. A particularly preferred application area for the present invention is its use for treating an exhaust gas from large-volume internal combustion engines, in particular diesel engines, especially in locomotives and water-borne vehicles.

The exhaust gases from internal combustion engines contain undesirable substances, the levels of which in the exhaust gas must be below statutory emission limits in many countries. That includes the concentration of particulates in the exhaust gas, which in many countries must not exceed specific levels. However, in particular in the case of large-volume internal combustion engines, in some cases it is difficult to comply with those emission limits, especially under idling conditions.

BRIEF SUMMARY OF THE INVENTION

It is accordingly an object of the invention to provide a process and an apparatus for treating exhaust gas of an internal combustion engine and a vehicle having the apparatus, which overcome the hereinafore-mentioned disadvantages of the heretofore-known processes and apparatuses of this general type and with which the emission of undesirable substances can be reliably reduced even for large-volume internal combustion engines.

With the foregoing and other objects in view there is provided, in accordance with the invention, a process for treating an exhaust gas from an internal combustion engine. The process comprises providing at least two modules for exhaust-gas treatment, and at least partly diverting an exhaust-gas stream as a function of a loading state of the internal combustion engine to cause at least parts of the exhaust gas to flow through at least one of the modules.

In this context, the term exhaust-gas treatment is to be understood in particular as meaning a reduction in the concentration of at least one component in the exhaust gas. In the present context, exhaust-gas treatment is preferably also understood as meaning a reduction in the level of particulates in the exhaust gas. The loading state of the internal combustion engine has an effect, in particular, on the following exhaust-gas variables: temperature, exhaust-gas mass flow, pollutant concentration and/or mean exhaust-gas velocity. It is often the case that only a very small number of load points, for example an idling load point, a partial load point and a full load point, occur especially in large-capacity internal combustion engines, in particular corresponding diesel engines, which are used in railcars, for example locomotives, water-borne vehicles, for example ships and/or boats, and in stationary operation. By suitably configuring the modules and suitably adopting a procedure, it is possible in this way to effect an exhaust-gas treatment that is accurately matched to the above-mentioned load points. For example, all of the modules can be formed as an idling module which is adapted to the exhaust-gas situation in idling mode and is therefore suitable for treating the exhaust gas under idling conditions. By suitably controlling the connecting device, it is possible to divert the exhaust-gas stream in such a way that a total exhaust-gas stream is applied substantially equally to at least two modules. A total exhaust-gas stream is to be understood in particular as meaning an exhaust-gas stream, especially an exhaust-gas mass or volumetric flow, which is integrated and/or cumulative over the time for which it flows through the corresponding module. This leads to a substantially equal flow through the modules. In particular, if each module includes at least one particulate filter for reducing the particulate content in the exhaust gas, uniform loading and if appropriate also a uniformly changing pressure loss is advantageously achieved.

A first module may be formed in such a way that it alone or in combination with a further module is adapted to the exhaust-gas situation at the partial load point, while a second module may be formed in such a way that it, in conjunction with a further module and the first module, is adapted to the exhaust-gas situation at the full load point. In this way, a modular structure and a suitable diversion of the exhaust gas can lead in each case to optimum conversion of the exhaust gas at the various load points.

A module generally includes at least one honeycomb body which has cavities, for example passages, through which an exhaust gas can flow. A honeycomb body may, in particular, be a ceramic and/or a metallic honeycomb body. A ceramic honeycomb body can be produced as an extruded monolith, while a metallic honeycomb body may include at least one at least partially structured layer, which has in particular been deformed in such a way as to form cavities through which an exhaust gas can flow. This deformation is to be understood in particular as meaning winding or twisting of at least one stack composed of at least one metallic layer. In this case it is also possible to use substantially smooth layers which, together with the structures of the at least partially structured layer, form the cavities. The honeycomb body may also include walls which in part allow a fluid to flow through them. The honeycomb body may form or include a particulate filter.

The effectiveness of an exhaust-gas treatment is highly dependent on the flow conditions through the corresponding module. For example, it is advantageous in particular for there to be, as far as possible, no laminar flows within the module, but rather for the flows, as far as possible, to be turbulent. In this way it is possible to effectively avoid laminar boundary flows which result in only a small part of the exhaust gas coming into contact with the walls of the cavities in the honeycomb body, which generally have a catalytically active coating. This is particularly important if an open particulate filter is included in the module, since the effectiveness of such a filter is highly dependent on a corresponding turbulent flow. In particular, in the case of large-volume internal combustion engines, however, the generally large dimensions of the corresponding exhaust-gas systems as well as the low idling speed of such engines in idling mode means that the exhaust-gas mass flow is very low, resulting in low flow velocities. This leads to a relatively low Reynolds number of the flow as it flows through the modules and therefore to possibly too low a degree of turbulence. In this case, the process according to the invention can lead to an increase in the Reynolds number by, as it were, reducing the total available surface area of the modules for the exhaust gas to flow through in order to be treated, thereby increasing the flow velocity and Reynolds number.

By way of example, it is possible for a corresponding exhaust-gas system to include four modules for reducing the particulate concentration in the exhaust gas. In idling mode, the installation is operated in such a way, through suitable actuation of the connecting device, that in each case only one of four possible modules has the exhaust gas flowing through it. Although this also reduces the respective maximum available reaction and filtration surface area, it particularly advantageously leads to an increase in the flow velocity and therefore to an increase in the Reynolds number of the flow. However, there is no disadvantage in the lower reaction and/or filter surface area, since under idling conditions in particular, the level of particulates is so low that the corresponding filter or reaction surface area of the module is sufficient to achieve enough respective conversion and filtering. In this way, even in idling mode of large-volume internal combustion engines, the exhaust gas can be effectively treated. This is advantageous since in particular in large-volume internal combustion engines, there are prolonged idling or low-load phases, for example when switching locomotives are waiting for the next switch or for ship engines which, for example in port, are used only to supply power.

As the load rises, i.e. for example as the internal combustion engine speed increases, it is possible, for example, to gradually switch further modules to have exhaust gas flowing through them. At higher engine speeds, a higher mean exhaust-gas velocity and a higher exhaust-gas mass flow are generally present, and consequently it is then advantageous for the exhaust gas to flow through a plurality of modules in order to provide a sufficiently large respective reaction and filter surface area.

In accordance with another mode of the process of the invention, in each module at least a reduction in the particulate concentration of the exhaust gas flowing through the module takes place.

For this purpose, a particulate filter may, in particular, be provided in each of the modules. The provision of further components is possible and advantageous. For example, a suitable oxidation catalytic converter on a honeycomb body may be provided upstream of the particulate filter, leading in particular to oxidation of nitrogen monoxide (NO) to nitrogen dioxide ($NO_2$), which serves as an oxidizing agent for the carbon contained in the particulates. A particulate filter of this type is known as a continuously regenerating particulate filter (CRT or Continuous Regenerating Trap).

In accordance with a further mode of the process of the invention, the reduction in the particulate concentration takes place in an open particulate filter.

An open particulate filter is to be understood as meaning a particulate filter in which the exhaust gas flowing through the particulate filter does not have to flow through a wall of the particulate filter. The alternative is a closed particulate filter, in which a multiplicity of passages are formed, of which in each case some are open on the entry side and closed on the exit side, while others are closed on the entry side and open on the exit side. In this way, the exhaust-gas stream is forced to flow through the porous wall of the particulate filter, in order to pass from a passage that is open on the entry side into a passage that is open on the exit side. As the exhaust gas flows through the wall, the particulates which it contains are filtered out. Open filters are also understood as bypass flow filters in which there is no filtering of the main stream, for example by a diesel particulate filter with passages closed on alternate sides, but rather only filtering of a bypass flow.

An open particulate filter therefore cannot per se become blocked. Although it is theoretically possible for the porous walls used as filter surfaces to become laden with particulates to such an extent that particulates are no longer filtered, in this case the unfiltered exhaust gases can continue to flow through the particulate filter unimpeded. In contrast, a closed filter in which the filter surfaces become blocked forms a very high back-pressure which ultimately means that exhaust gas can no longer flow through the particulate filter. In this respect, an open particulate filter can also be understood as a barrier-free particulate filter.

In the case of an open particulate filter, it is particularly preferable for the filter to be composed of substantially smooth layers and at least partially corrugated layers. In particular, in this case the substantially smooth layer, at least in partial regions, may be composed of a material through which a fluid can flow and which is in particular porous, while the at least partially corrugated layer is composed for example of thin metal sheet or a thin sheet-metal foil or a thin metal foil. The corrugated layer may preferably have guide structures which are responsible for diverting the exhaust gas toward the filter regions. With regard to the configuration of these or similar guide structures, it is preferable for the structures to effect an increase in the velocity of the exhaust gas in the passage, so that in particular the proportion of the exhaust gas which remains in the open passage and flows past or along the filter surface is at a significantly increased velocity compared to the velocity of the exhaust gas when it enters the passage. Tests have shown that as the velocity of this bypass exhaust-gas stream increases, the separation rate of the filter surface(s) or the particulate trap can be increased.

The process according to the invention is advantageous, in particular, for an open particulate filter which is in each case included within the modules, since in this case it is ensured even at low idling speeds of, in particular, even large-volume internal combustion engines, that the flow in the modules has a Reynolds number which during flow through the particulate filter is sufficiently high to nevertheless bring about effective removal of the particulates or conversion of the component.

In accordance with an added mode of the process of the invention, a diversion of the exhaust gas takes place as a function of at least one of the following variables:

1) a regeneration capacity of the exhaust gas for a module, and 2) a need for regeneration of a module.

In this context, a diversion of the exhaust gas is to be understood as meaning a diversion by the connecting device. A regeneration of a particulate filter includes in particular an oxidation of the particulates held in the particulate filter. This can be effected firstly by providing an oxidizing agent, such as for example nitrogen dioxide, or as an alternative or indeed an addition, for example, by additional heating measures which increase the temperature of the particulate filter above a limit temperature above which the particulates are preferentially oxidized. If the exhaust gas is at a certain temperature that can lead to increased regeneration during flow through a module, it is possible to refer to a regeneration capacity of the exhaust gas as defined in 4.1) above. On the other hand, a need for reaction 4.2) of a module as referred to above, for example in the case of a particulate filter, means that the quantity of particulates that are present has exceeded a limit value above which it is advantageous to regenerate the module. In particular, in a particulate filter, this may also manifest itself in a rise in the pressure loss across the particulate filter.

In accordance with an additional mode of the process of the invention, in an idling load state, the exhaust-gas stream is diverted in such a way that on average a substantially identical total exhaust-gas stream flows through substantially all of the modules.

In this context, a total exhaust-gas stream is to be understood as meaning the sum and/or the integral over time of the exhaust-gas stream, preferably of the exhaust-gas mass flow or the exhaust-gas volumetric flow, over the time during which the exhaust gas flows through the module in question. The total exhaust-gas stream therefore preferably constitutes a mass, if it is the exhaust-gas mass flow that is under consideration, or a volume, if it is the exhaust-gas volumetric flow that is under consideration. In this context, in particular, through-flow times of up to 5 minutes, up to 10 minutes or even of an hour or more are possible and in accordance with the invention. In principle, it is preferable in this case to adopt a procedure in which the flow velocity in a module, preferably in a passage of a honeycomb body that is at least part of a module, lies in a range from 10 meters per second to 25 meters per second.

In accordance with yet another mode of the process of the invention, the number of modules through which the exhaust gas flows increases monotonically to at least one of the following variables:

1) exhaust-gas temperature, and
2) exhaust-gas mass flow.

It is particularly advantageous to be dependent on the exhaust-gas mass flow, since otherwise, for example if the exhaust gas is flowing through just one module, at higher loading states, in particular even at full load, flow through just one module may be disadvantageous for the effectiveness of exhaust-gas treatment. In particular, if each of the modules includes an open particulate filter, it is advantageous if the exhaust gas flows through all of the modules up to the full-load state of the internal combustion engine. Regeneration of the particulate filters in question can also take place, in particular, during the full-load state.

With the objects of the invention in view, there is also provided an apparatus for treating an exhaust gas from an internal combustion engine. The apparatus comprises an exhaust pipe to be connected to the internal combustion engine, at least two modules to be connected to the exhaust pipe for exhaust-gas treatment, and at least one connecting device, associated with at least one of the modules, for connecting the at least one module to the exhaust pipe to cause at least part of the exhaust gas to flow through the at least one module.

Each module includes, in particular, a honeycomb body, which preferably includes a corresponding catalytically active coating and/or is suitable for particulate filtering. A connecting device is to be understood, in particular, as meaning a component through the use of which a connection to the module through which a fluid can flow can be produced or disconnected. The connecting device is preferably a correspondingly constructed flap, which in the closed state can close a through-flow opening leading to the module and in the open state can open the opening. In particular, the various connecting devices can be provided in such a way that in each case only part of the exhaust gas can flow through the associated module or alternatively all of the exhaust gas can flow through the associated module. In particular, in the case of the latter option, various connecting devices can interact.

In accordance with another feature of the apparatus of the invention, the connecting device is provided in such a way that exhaust gas can flow through each module alone.

Thus, the apparatus according to the invention can be operated in such a way that, in particular in idling mode, exhaust gas flows to a uniform extent through the individual modules, so that the individual modules are utilized equally. In particular, if the modules include particulate filters, it is possible in this way to achieve a substantially uniform loading of the particulate filters in the modules. This leads to a substantially uniform pressure loss across the respective modules.

In accordance with a further feature of the apparatus of the invention, each module effects at least a reduction in the particulate concentration of the exhaust-gas stream flowing through the module.

In accordance with an added feature of the apparatus of the invention, it is preferable for each module to include at least one particulate filter, which is particularly preferably open. For a definition of an open particulate filter, reference is made to the statements made above and to International Publication No. WO 02/00326 A2, corresponding to U.S. Pat. No. 6,712,884, the content of the disclosure of which in connection with the structure of the particulate filter is hereby incorporated by reference into the instant application.

In accordance with an additional feature of the apparatus of the invention, the connecting device includes at least one flap.

A flap constitutes a connecting device that is, on one hand, simple to produce and is, on the other hand, able to effectively produce or stop a connection to a module. Furthermore, flaps are simple to actuate and have proven stable and durable when used in exhaust-gas systems.

In accordance with yet another feature of the apparatus of the invention, the connecting device is configured in such a way that when the exhaust gas can flow through the associated module, it excludes at least one further module from the exhaust-gas flow.

This can be realized, in particular, by a flap that has three possible positions:

1) a first position, in which the connection to the module is closed,
2) a second position, in which the connection to the module is open and the exhaust pipe is blocked, so that all of the exhaust gas that is present at the connection to the module flows through this module, and
3) a third position, in which exhaust gas can flow freely through both the module and the exhaust pipe.

Flaps of this type can be used, in particular, to realize an apparatus according to the invention in which exhaust gas can flow through all of the modules individually.

With the objects of the invention in view, there is furthermore provided a rail-borne vehicle, preferably a railway motor car, particularly preferably a locomotive, which includes an apparatus according to the invention or in which a process according to the invention takes place.

With the objects of the invention in view, there is concomitantly provided a water-borne vehicle which includes an apparatus according to the invention or in which a process according to the invention takes place.

The process and the apparatus according to the invention can particularly advantageously be deployed in exhaust-gas systems of diesel engines. It is preferable for the rail-borne vehicle and the water-borne vehicle to also have a diesel engine. Furthermore, it is possible for the apparatus and the process according to the invention to be used in stationary internal combustion engines, in particular diesel internal combustion engines.

The advantages and details which have been disclosed with respect to the process according to the invention can also be transferred to and exploited in the same way in the apparatus according to the invention. The same also applies to the details and advantages disclosed with respect to the apparatus according to the invention, which can equally be transferred to and exploited in the process according to the invention. The apparatus according to the invention is suitable, in particular, for carrying out the process according to the invention.

Other features which are considered as characteristic for the invention are set forth in the appended claims.

Although the invention is illustrated and described herein as embodied in a process and an apparatus for treating exhaust gas of an internal combustion engine and a vehicle having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
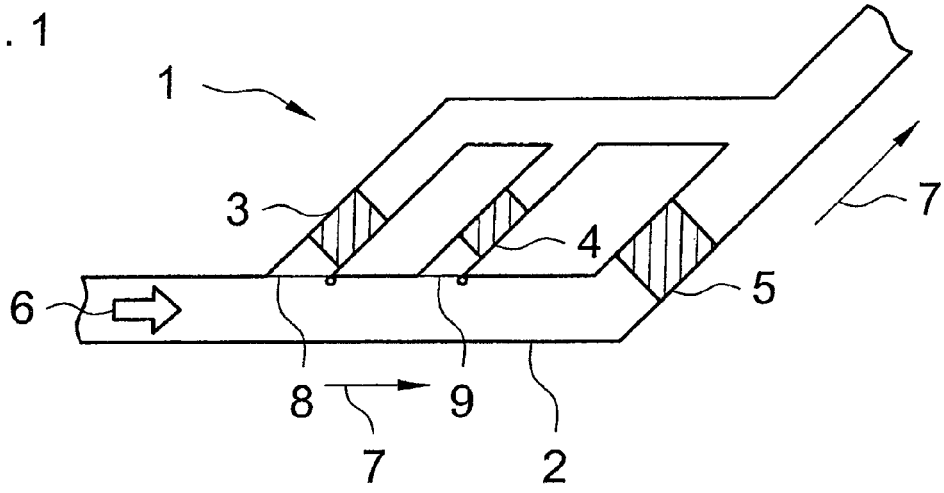
FIG. 1 is a fragmentary, diagrammatic, perspective view of a first exemplary embodiment of an apparatus according to the invention.

Referring now to the figures of the drawings in detail and first, particularly, to FIG. 1 thereof, there is seen a diagrammatic illustration of a first exemplary embodiment of an apparatus 1 according to the invention for treating an exhaust gas 6. The apparatus includes an exhaust pipe 2, a first module 3 and a second module 4 for exhaust-gas treatment. An idling module 5 is also provided. A non-illustrated internal combustion engine emits the exhaust gas 6 which flows through the exhaust pipe 2 in a through-flow direction 7. The first module 3 for exhaust-gas treatment is assigned a first connecting device 8. In the present, first exemplary embodiment, the connecting device 8 includes a pivotable flap, through the use of which the module 3 can be connected to the exhaust pipe 2 in such a way that at least part of the exhaust gas 6 can flow through the module 3. A second connecting device 9 is provided in a corresponding way and is assigned to the second module 4 for exhaust-gas treatment.

The idling module 5 is not assigned a connecting device, since the exhaust gas 6 flows through this idling module 5 even when the first connecting device 8 and the second connecting device 9 are in a first position preventing flow through the first module 3 and the second module 4. In particular, for large-volume internal combustion engines, for example of locomotives, of water-borne vehicles, such as ships or boats in particular, and of stationary installations, it is advantageous for the idling module 5 to be adapted to the exhaust-gas situation during idling phases. By way of example, in the case of a switching locomotive, the internal combustion engine is in idling mode for a very large part of its operating time, and it is therefore useful to adapt to idling conditions. Moreover, large-volume internal combustion engines have a very low idling speed and very low flow velocities and consequently low Reynolds numbers in idling mode. If the exhaust gas 6 were to also flow through both the idling module 5 as well as the first module 3 and the second module 4 for exhaust-gas treatment in idling mode, the result would be a very low Reynolds number of the exhaust-gas flow in all of the modules 3, 4, 5. This would lead to more of a laminar flow, which is generally undesirable in modules for exhaust-gas treatment.

Figure 2:
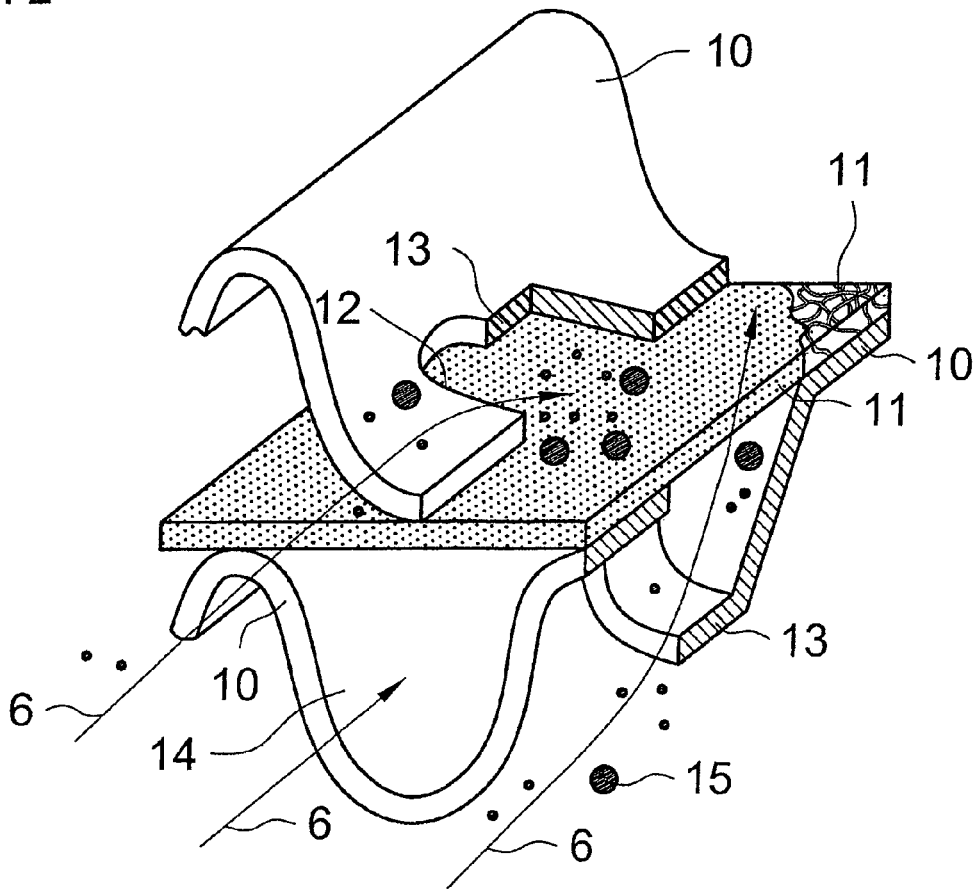
FIG. 2 is an enlarged, fragmentary, perspective view of a portion of a module of an apparatus according to the invention.

If, for example, open particulate filters are included within the modules 3, 4, 5, however, laminar flow through these particulate filters is undesirable. FIG. 2 diagrammatically depicts a portion of an open particulate filter of this type. An open particulate filter of this type is formed, for example, from corrugated metallic layers 10 and substantially smooth layers 11. The substantially smooth layers 11 are formed from a material which at least in part allows a fluid to flow through it, for example a sintered porous material or a porous fiber material.

In this case, the illustrated corrugated metallic layer 10 has apertures 12 which form guide vanes 13. The substantially smooth layers 11 and the corrugated metallic layers 10 form passages 14 through which the exhaust gas 6 can flow. The exhaust gas 6 follows flow lines indicated by arrows. The apertures 12 and the guide vanes 13 cause the exhaust gas 6 to be guided through the substantially smooth layer 11. Particulates 15 contained in the exhaust gas 6 accumulate in the substantially smooth layer 11.

Figure 3:
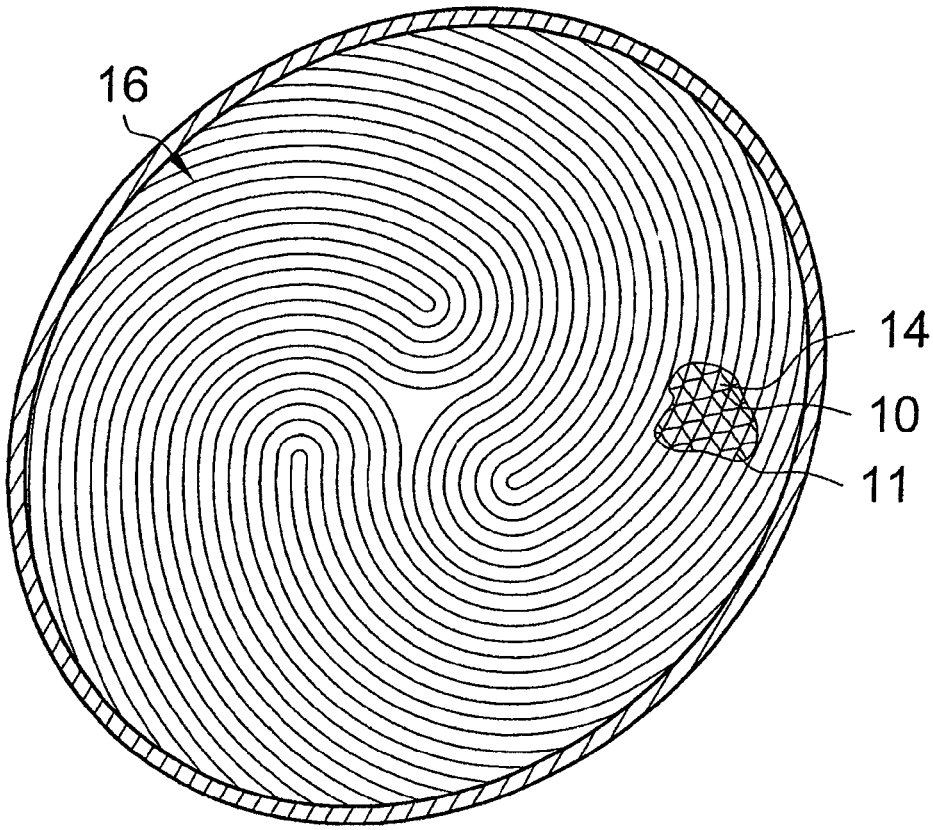
FIG. 3 is a cross-sectional view as seen from an end of a module of an apparatus according to the invention.

A module 3, 4, 5 may include at least one honeycomb body 16, as is diagrammatically depicted in cross section in FIG. 3. In this case, the honeycomb body 16 is formed from corrugated metallic layers 10 and substantially smooth layers 11. These layers 10, 11 have been stacked to form three stacks, and these stacks have then been intertwined so as to form passages 14. In addition to a particulate filter, it is also possible to form other types of honeycomb bodies. By way of example, it is possible to form honeycomb bodies 16 which carry a catalytically active coating and/or are formed just from metal foils. In particular, this catalytically active coating may include a washcoat having catalytically active particulates. In particular, it is also advantageous if a module 3, 4, 5 includes an oxidation catalytic converter, the catalytically active centers of which catalyze at least the oxidation of nitrogen monoxide to nitrogen dioxide and include a corresponding open particulate filter downstream of this oxidation catalytic converter. The nitrogen dioxide formed in this way can then advantageously be used to regenerate the particulate filter, i.e. to oxidize the particulates 15. Both the substantially smooth layers 11 and the corrugated layers 10 may be formed from thin metal foils. It is possible to do without the formation of guide vanes 13 and apertures, in particular if the honeycomb body 16 is used not as a particulate filter but rather exclusively as a carrier for a catalytically active coating.

Figure 4:
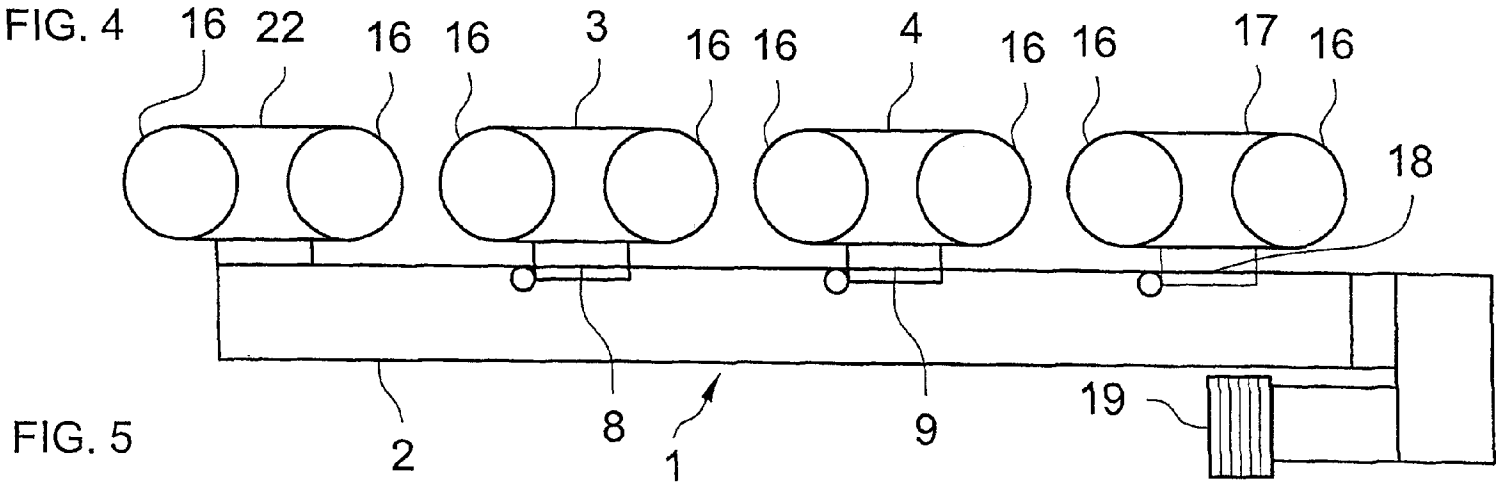
FIG. 4 is a first longitudinal-sectional view of a second exemplary embodiment of an apparatus according to the invention.

FIG. 4 diagrammatically depicts a second exemplary embodiment of an apparatus 1 according to the invention for exhaust-gas treatment. This apparatus 1 includes an exhaust pipe 2, a first module 3, a second module 4, a third module 17 and a fourth module 22 for exhaust-gas treatment. An idling module is not provided in this case. Furthermore, a first connecting device 8, a second connecting device 9 and a third connecting device 18 are provided and assigned to the respective modules 3, 4, 17. The connecting devices 8, 9, 17 therefore number one fewer than the modules 3, 4, 17, 22. The connecting devices 8, 9, 17 are formed in such a way that exhaust gas can flow through each module 3, 4, 17, 22 alone. In this way, the exhaust gas emitted by an internal combustion engine 19 can be advantageously diverted through the use of the connecting devices 8, 9, 18, as a function of a loading state of the internal combustion engine 19, in such a way that at least parts of the exhaust gas flow through one or more modules 3, 4, 17, 22 for exhaust-gas treatment.

In particular, according to the second exemplary embodiment of an apparatus 1 according to the invention, it is advantageously possible in the idling state to divert the exhaust-gas stream in such a way that on average a substantially identical total exhaust-gas stream flows through all of the modules 3, 4, 17, 22. Therefore, in idling mode, substantially all of the modules 3, 4, 17, 22 are acted on substantially uniformly.

Figure 5:
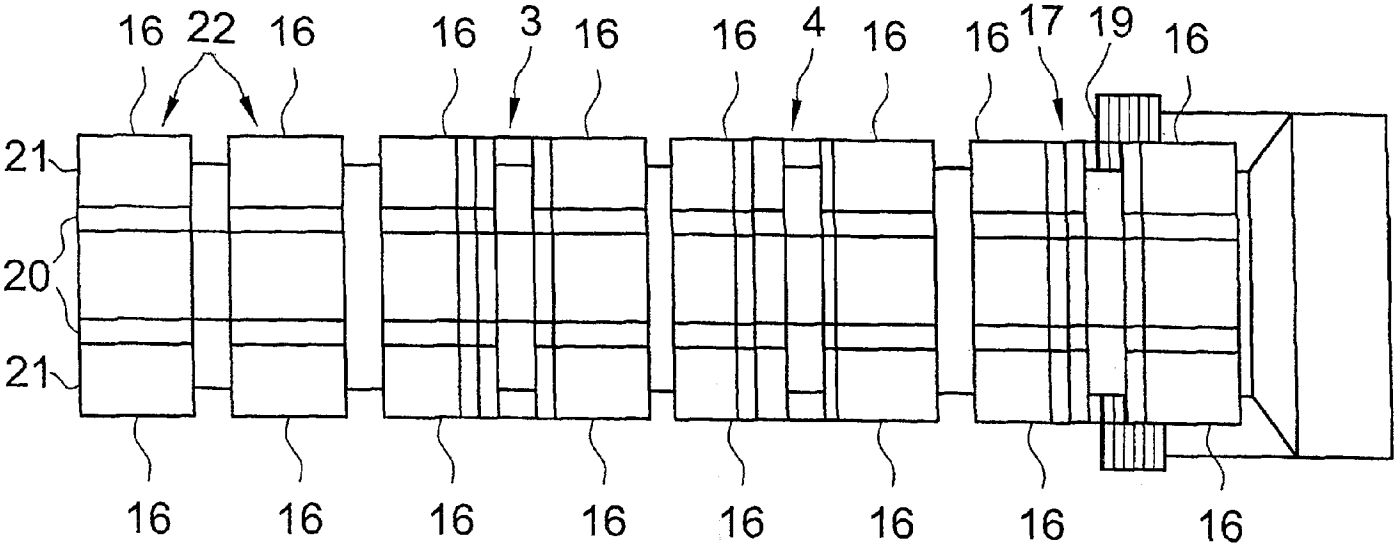
FIG. 5 is a second longitudinal-sectional view of the second exemplary embodiment of an apparatus according to the invention.

FIG. 5 diagrammatically illustrates a further longitudinal section through the second exemplary embodiment of an apparatus 1 according to the invention for treating an exhaust gas from an internal combustion engine 19. Each of the modules 3, 4, 17, 22 includes a plurality of honeycomb bodies 16. Each of the honeycomb bodies 16 may include various zones. This will be explained in more detail below on the basis of the example of the honeycomb bodies 16 of the fourth module 22. Each of the honeycomb bodies 16 of the fourth module 22 includes an oxidation catalytic converter zone 20 and a particulate filter zone 21. These zones 20, 21 are disposed in such a way that the exhaust gas flows firstly through the oxidation catalytic converter zone 20 and then through the particulate filter zone 21. Further catalytic converter zones are also shown in the further modules 3, 4, 17 and are provided in such a way that they are adapted to the respective loading states at which these modules 3, 4, 5, 17 are connected. They may, in particular, be further oxidation catalytic converter zones 20, zones for conversion of nitrogen oxides and standard three-way catalytic converter zones. These are only examples and other catalytic converter zones are possible and covered by the scope of the invention. As an alternative to having a plurality of zones 20, 21 per module 3, 4, 17, 22, it is also possible for a plurality of corresponding honeycomb bodies 16 to be provided in series.

In particular, the apparatus for treating an exhaust gas can be operated in such a way that the diversion of the exhaust gas effected by the connecting devices 8, 9, 18 takes place as a function of the regeneration capacity of the exhaust gas 6 and a need for regeneration of a module 5, 3, 4, 17, 22. This means that when the exhaust gas satisfies certain parameters required for the regeneration of the particulate filter zones 21, for example exceeds a certain limit temperature, this exhaust gas is passed in a targeted way to a module 3, 4, 17, 22 that is in need of regeneration. This can be effected, in particular, by the connecting devices 8, 9, 18, which are provided in such a way that, in addition to a connection of the respective modules 5, 3, 4, 17, 22, it is also possible to prevent flow through other modules. The oxidation catalytic converter zone 20 and the particulate filter zone 21 may also be provided as individual honeycomb bodies 16 through which exhaust gas can flow in succession.

Figure 6:
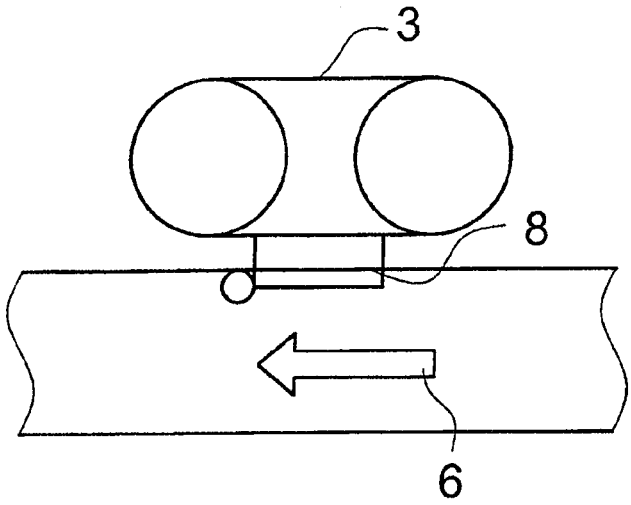
FIG. 6 is a fragmentary, longitudinal-sectional view of a portion of an apparatus according to the invention with a connecting device in a first position.

FIG. 6 diagrammatically illustrates a portion of an apparatus 1 according to the invention. In this case, a connecting device 8 assigned to a first module 3 for exhaust-gas treatment is in a first position, with the result that the exhaust gas 6 from the internal combustion engine 19 does not flow through the first module 3, but rather bypasses it.

Figure 7:
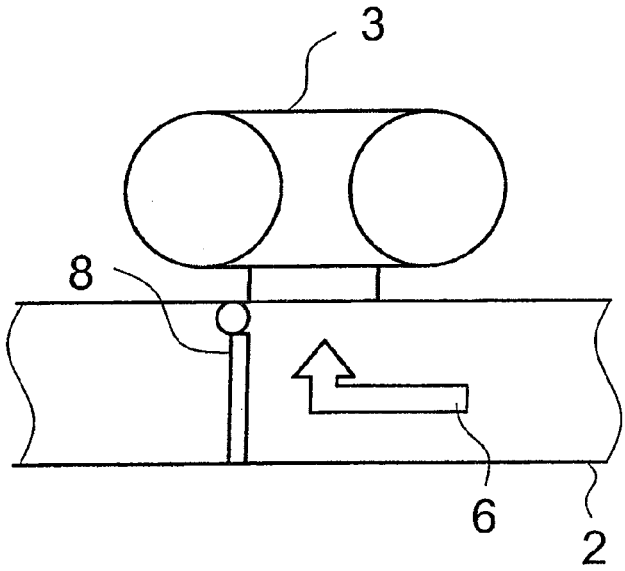
FIG. 7 is a fragmentary, longitudinal-sectional view of a portion of an apparatus according to the invention with a connecting device in a second position.

FIG. 7 diagrammatically illustrates the same portion of an apparatus according to the invention, in which the connecting device 8 has adopted a second position. This closes the exhaust pipe 2 so that the exhaust gas 6 from the internal combustion engine 19 flows through the module 3. Depending on whether further modules are also provided upstream of the first module 3, either all of the exhaust gas 6 from the internal combustion engine flows through the first module 3 or only a corresponding proportion of the exhaust gas 6 does so. The proportion in this case depends on the pressure losses in the parts of the exhaust-gas system through which the exhaust gas can flow.

Figure 8:
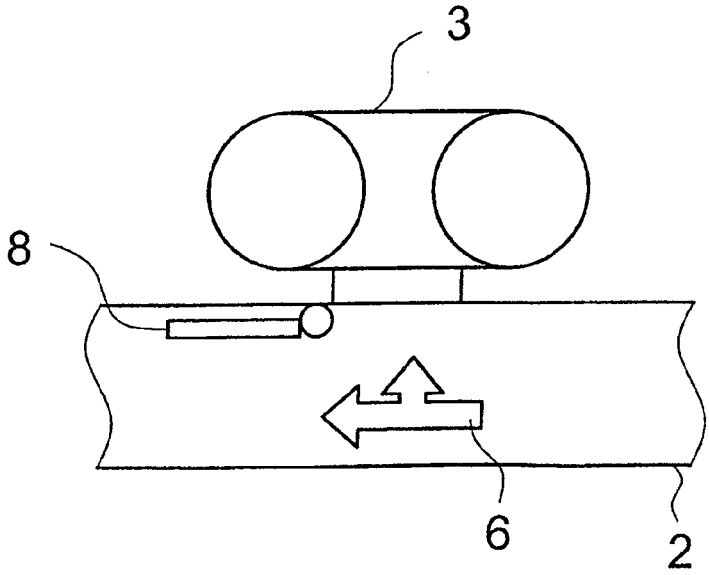
FIG. 8 is a fragmentary, longitudinal-sectional view of a portion of an apparatus according to the invention with a connecting device in a third position.

FIG. 8 diagrammatically illustrates the connecting device 8 in a third position. In this case, access to the first module 3 is open, so that a part of the exhaust gas 6 can flow through the module 3. However, a further part of the exhaust gas 6 can flow onward through the exhaust pipe 2. The distribution of the partial-streams which flow through the exhaust pipe 2 and the module 3 is dependent on the pressure loss in the respective partial regions 2, 3 through which the exhaust gas is to flow.

Providing the connecting devices 8, 9, 18 in a corresponding or similar way to that shown in FIGS. 6 to 8 advantageously makes it possible to implement a procedure in which exhaust gas can flow through each module individually. This, in particular, means that it is advantageously possible, in particular in idling mode, for each module 3, 4, 17, 22 to be fed, in particular, with a substantially uniform total exhaust-gas stream.

The process according to the invention and the apparatus 1 according to the invention advantageously enable even the exhaust-gas systems of large-volume internal combustion engines 19 to be configured in such a way that, even in idling mode and in principle at very low exhaust-gas mass flow rates, the exhaust gas 6 is converted and treated in the individual modules 5, 3, 4, 17, 22. The individual modules can be adapted to different load points of the internal combustion engine 19.

The invention claimed is:

1. An apparatus for treating an exhaust gas from an internal combustion engine, the apparatus comprising:

an exhaust pipe to be connected to the internal combustion engine;

at least two modules to be connected to said exhaust pipe for exhaust-gas treatment; and at least one connecting device, associated with at least one of said modules, for connecting said at least one module to said exhaust pipe to cause at least part of the exhaust gas to flow through said at least one module, said at least one connecting device being configured for permitting the exhaust gas to flow through said module associated therewith while excluding at least one further module from the exhaust-gas flow;

each said at least one connecting device being configured to be movable between:

a first position to produce a connection to a respective one of said modules through which a fluid can flow, a second position to disconnect a connection to said respective one of said modules through which a fluid can flow, and a third position to prevent flow through others of said modules; and said at least one connecting device numbering one fewer than said at least two modules.

2. The apparatus according to claim 1, wherein said at least one connecting device causes the exhaust gas to flow through each of said modules alone.

3. A rail-borne vehicle, comprising the apparatus according to claim 1.

4. A water-borne vehicle, comprising the apparatus according to claim 1.

5. The apparatus according to claim 1, wherein said at least two modules include three modules and said at least one connecting device includes two connecting devices each associated with a respective one of said modules.

6. The apparatus according to claim 1, wherein each of said modules effects at least a reduction in particulate concentration of an exhaust-gas stream flowing through said module.

7. The apparatus according to claim 6, wherein each of said modules includes at least one particulate filter.

8. The apparatus according to claim 7, wherein said at least one particulate filter is open.

* * * * *